US010775124B2

(12) United States Patent
Domholt et al.

(10) Patent No.: US 10,775,124 B2
(45) Date of Patent: Sep. 15, 2020

(54) MOTOR-LESS CARTRIDGE RING GEAR ENGAGEMENT MODULE FOR ACTUATING ROTATION OF A TURRET

(71) Applicant: NPC Robotics Corporation, Mound, MN (US)

(72) Inventors: Norman L. Domholt, Minnetrista, MN (US); Richard Reid, Minnetonka, MN (US); John David, Mound, MN (US); Tyler Andrew Jacobson, Chaska, MN (US); Michael Richmon Thoreson, Mound, MN (US)

(73) Assignee: NPC Robotics Corporation, Mound, MN (US)

( * ) Notice: Subject to any disclaimer, the term of this patent is extended or adjusted under 35 U.S.C. 154(b) by 12 days.

(21) Appl. No.: 16/226,264

(22) Filed: Dec. 19, 2018

(65) Prior Publication Data

US 2020/0025502 A1 Jan. 23, 2020

Related U.S. Application Data

(60) Continuation-in-part of application No. 15/704,910, filed on Sep. 14, 2017, now Pat. No. 10,330,422, (Continued)

(51) Int. Cl.
*F41A 27/20* (2006.01)
*F41A 27/18* (2006.01)
(Continued)

(52) U.S. Cl.
CPC ..... *F41A 27/20* (2013.01); *F41A 23/24* (2013.01); *F41A 27/18* (2013.01); *F41G 5/02* (2013.01);
(Continued)

(58) Field of Classification Search
CPC ..... F41A 27/18; F41A 27/20
See application file for complete search history.

(56) References Cited

U.S. PATENT DOCUMENTS 2,354,204 A * 7/1944 Gentry ..... F41A 27/20 475/209
2,437,646 A * 3/1948 Matulaitis ..... F41A 27/20 318/367
(Continued)

FOREIGN PATENT DOCUMENTS

GB 541767 A * 12/1941 ..... F41A 27/20

*Primary Examiner* — Joshua T Semick
(74) *Attorney, Agent, or Firm* — Craige Thompson; Thompson Patent Law

(57) ABSTRACT

Apparatus and associated methods relate to a motor-less cartridge ring gear engagement module (CRGEM) for a turret-rotating system that includes a main drive gear configured to rotate in a rotation plane, a manual input shaft that extends substantially orthogonal relative to the rotation plane, and a drive shaft that extends substantially orthogonal relative to the rotation plane, where the drive shaft and the manual input shaft extend substantially parallel to one another. In an illustrative example, both the main drive gear and a hand crank may be located on a top surface of the CRGEM. In some embodiments, a manual drive cap may be hingedly coupled to the gearbox and configured to rotate in a vertical plane that is substantially orthogonal to the rotation plane. At least some examples may provide for a hand-operated, manual traverse unit that advantageously does not require electrical power to operate.

18 Claims, 6 Drawing Sheets

Related U.S. Application Data which is a continuation of application No. 15/055,384, filed on Feb. 26, 2016, now Pat. No. 10,281,238, which is a continuation-in-part of application No. 14/722,819, filed on May 27, 2015, now Pat. No. 9,733,037, which is a continuation of application No. 13/895,787, filed on May 16, 2013, now Pat. No. 9,759,506, which is a division of application No. 12/751,254, filed on Mar. 31, 2010, now Pat. No. 8,443,710.

(60) Provisional application No. 61/165,310, filed on Mar. 31, 2009.

(51) Int. Cl.

| | |
|---|---|
| ***F41G 5/14*** | (2006.01) |
| ***F41A 23/24*** | (2006.01) |
| ***F41G 5/02*** | (2006.01) |

(52) U.S. Cl.

CPC ..... *F41G 5/14* (2013.01); *Y10T 29/49947* (2015.01); *Y10T 74/19* (2015.01); *Y10T 74/19051* (2015.01)

(56) References Cited

U.S. PATENT DOCUMENTS

| | | | | | |
|---|---|---|---|---|---|
| 3,429,222 | A * | 2/1969 | Flannery | F41A 27/20 | 89/41.02 |
| 3,636,789 | A * | 1/1972 | Geiger | F16H 57/12 | 74/409 |
| 4,338,853 | A * | 7/1982 | Neumeyer | F16H 57/12 | 74/384 |
| 8,443,710 | B2 * | 5/2013 | Domholt | F41A 27/20 | 89/41.02 |
| 8,607,686 | B2 * | 12/2013 | McKee | F41A 27/20 | 89/41.01 |
| 2011/0067513 | A1 * | 3/2011 | Wilson | F41A 27/18 | 74/416 |

* cited by examiner

MOTOR-LESS CARTRIDGE RING GEAR ENGAGEMENT MODULE FOR ACTUATING ROTATION OF A TURRET

CROSS-REFERENCE TO RELATED APPLICATIONS

This application claims the benefit and is a Continuation-in-Part of U.S. application Ser. No. 15/704,910 titled "Cartridge Based Modular Turret Control System," filed by Domholt, et al. on Sep. 14, 2017, which is a Continuation of U.S. application Ser. No. 15/055,384, titled "Cartridge Based Modular Turret Control System," filed by Domholt, et al. on Feb. 26, 2016, which is a Continuation-in-Part of U.S. application Ser. No. 14/722,819, now issued as U.S. Pat. No. 9,733,037, titled "Battery-Powered Motor Unit," filed by Domholt, et al. on May 27, 2015, which is a Continuation of U.S. application Ser. No. 13/895,787, now issued as U.S. Pat. No. 9,759,506, titled "Battery-Powered Motor Unit," filed by Domholt, et al. on May 16, 2013, which is a Divisional of U.S. application Ser. No. 12/751,254, now issued as U.S. Pat. No. 8,443,710, titled "Battery-Powered Motor Unit," filed by Domholt, et al. on Mar. 31, 2010, which claims the benefit of U.S. Provisional Application No. 61/165,310, titled "Battery-Powered Motor Unit," filed by Domholt, et al on Mar. 31, 2009.

This application incorporates the entire contents of the foregoing application(s) herein by reference.

TECHNICAL FIELD

Various embodiments relate generally to operation of turret systems.

BACKGROUND

Turret gun systems are commonly deployed in military operations. The turret gun systems may be mounted on structures such as buildings, or on vehicles, such as combat vehicles, aircrafts or ships.

Turret gun systems are commonly equipped on armored vehicles and have mountings for large caliber guns. For the turret gun systems to be effective, the rotation of the turret gun system must be accomplished very efficiently. Turret gun systems usually include shields to provide protection to the operator(s) of the turret gun system.

SUMMARY

Apparatus and associated methods relate to a motor-less cartridge ring gear engagement module (CRGEM) for a turret-rotating system that includes a main drive gear configured to rotate in a rotation plane, a manual input shaft that extends substantially orthogonal relative to the rotation plane, and a drive shaft that extends substantially orthogonal relative to the rotation plane, where the drive shaft and the manual input shaft extend substantially parallel to one another. In an illustrative example, both the main drive gear and a hand crank may be located on a top surface of the CRGEM. In some embodiments, a manual drive cap may be hingedly coupled to the gearbox and configured to rotate in a vertical plane that is substantially orthogonal to the rotation plane. At least some examples may provide for a hand-operated, manual traverse unit that advantageously does not require electrical power to operate.

Various embodiments may achieve one or more advantages. A motor-less CRGEM may operate with more free movement by a user. For example, a user using a hand crank that rotates in a horizontal plane may perform more natural and lower effort movements to rotate a turret. A motor-less CRGEM may not require an external or internal electrical power source, such as a battery or a generator, and may not require heavy or bulky motor components such as a rotor, stator, and/or magnets, with the end result of significantly reducing the weight of the system. A motor-less CRGEM may be more compact versus a motor-operated turret-rotating system, which may allow for easier operation and a smaller footprint turret-rotating system. A motor-less CRGEM may also completely eliminate any safety issues with a motor being mechanically coupled to a manual input crank, in that the input crank cannot be suddenly actuated by a motor due to the absence of a motor in the system. A removable handle/crank and input shaft cap may allow the motor-less CRGEM to be less obtrusive when not being manually operated by a user.

A motor-less CRGEM may, in some embodiments, include a brake that is mechanically coupled to a brake shaft, where the brake shaft is mechanically coupled to the main drive gear, such that the brake is configured to prevent rotation of the brake shaft to prevent rotation of the main drive gear. This may advantageously allow for a safety brake feature that reduces the chance of dangerous and wildly uncontrolled movement of a turret that could impart uncontrolled rotation of a crank handle attached to the manual input shaft. In some examples, rotation of any one of the brake shaft, the manual input shaft, and the main drive gear may impart rotation upon the other two, such that rotation of the handle while coupled to the manual input shaft may impart rotation upon the brake shaft, the manual input shaft, and the main drive gear. In at least some embodiments, the brake shaft, the manual input shaft, and the main drive gear are in continuous mechanical communication in all operating modes. This may advantageously permit the brake to halt movement of any of the gears, shafts, or mechanical components of the system, thus providing a global safety feature that prevents unwanted movement/rotation of any mechanical parts of the motor-less CRGEM.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
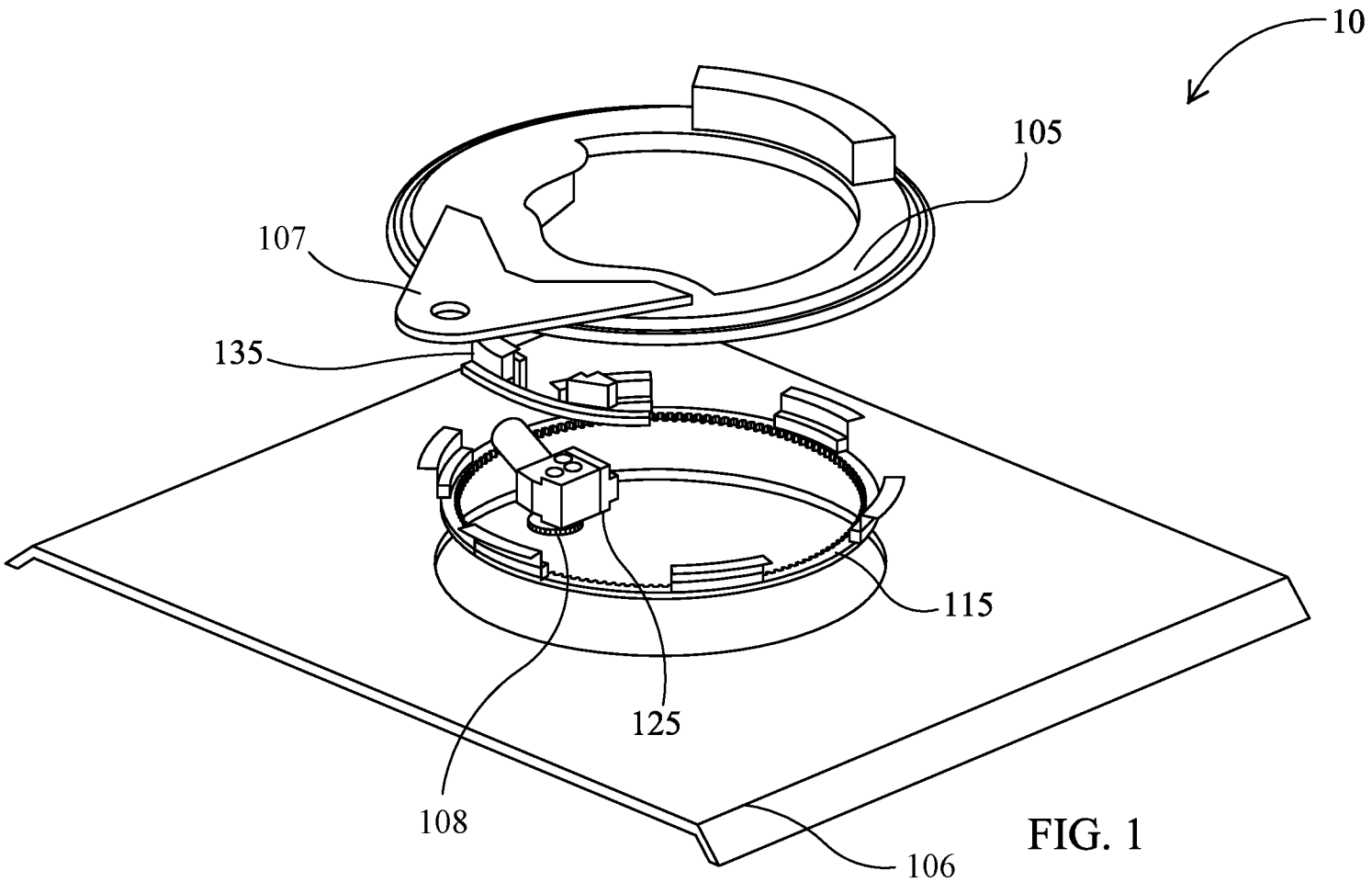
FIG. 1 depicts an exploded view of a turret system including an exemplary cartridge mounting assembly.

FIG. 1 depicts an exploded view of a turret system including an exemplary cartridge mounting assembly. As depicted in FIG. 1, a turret system 10 includes a cover plate 105 and a base plate 106. The cover plate 105 shields a ring gear 115 that is attached to the base plate. The cover plate 105, as depicted, includes an extended portion 107 where a motor-less cartridge ring gear engagement module (CRGEM) 125 communicates with the ring gear 115. The motor-less CRGEM 125 includes a gear engagement component 108, such that, when the motor-less CRGEM 125 installs on a cartridge mounting assembly (CMA) 135, the motor-less CRGEM 125 mounts to an inner race of a bearing (not shown) where the gear engagement component 108 is in operable communication with the ring gear 115 to actuate rotation of the turret system 10. A pair of slide flange securing mechanisms, such as, for example, install pins (not shown) may secure the motor-less CRGEM 125 when installed on the CMA 135.

At least some of the features, functions, and components of the motor-less CRGEM 125 may be the same as, or similar to, the features, functions, and components of the motorized system disclosed in U.S. patent application Ser. No. 13/895,787, now issued as U.S. Pat. No. 9,759,506, entitled "Battery-Powered Motor Unit," filed May 16, 2013 by Domholt, et al., the entire contents of which are herein incorporated by reference. For example, both may include a gearbox, a drive gear, and a drive shaft, for example. Both may be configured to directly engage teeth of a ring gear on a vehicle body. Both may include a releasably couplable hand crank, a manual input shaft, and a manual drive gear. Both may include a drive cap configured to cover a manual input shaft. However, there may be significant differences between the motorized system disclosed in U.S. patent application Ser. No. 13/895,787, and the motor-less CRGEM 125 disclosed herein. Persons of ordinary skill in the art may appreciate these differences upon careful reading of the present disclosure.

Figure 1B:
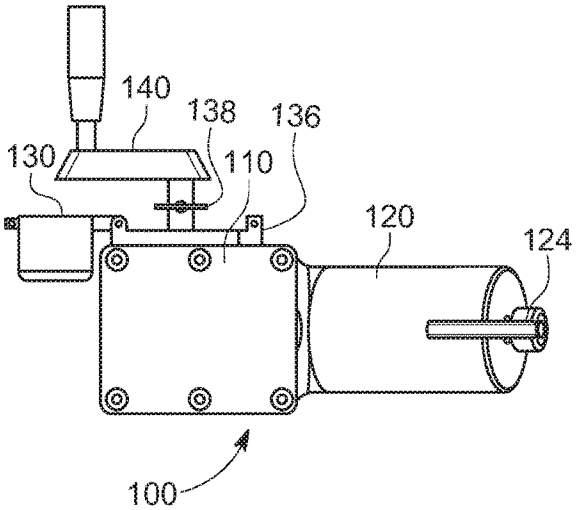
FIGS. 1A, 1B, and 1C depict perspective, side, and top views, respectively of an exemplary motor-less cartridge ring gear engagement module (CRGEM) for actuating rotation of a turret, the CRGEM including an exemplary crank having a crank shaft oriented in a vertical direction.
Figure 1C:
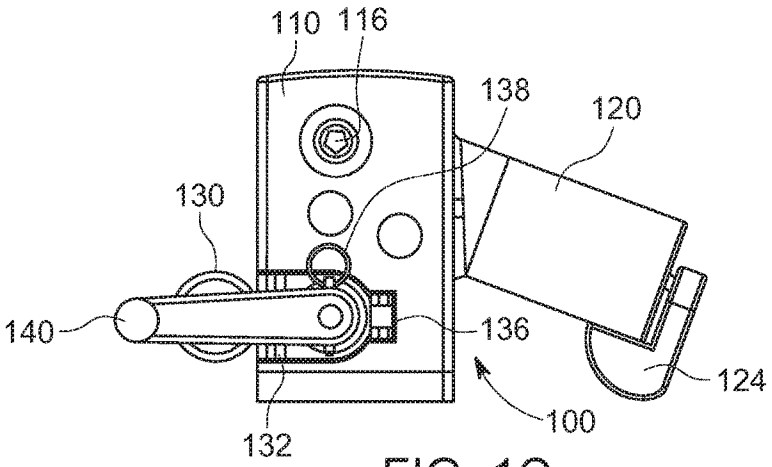
Figure 1A:
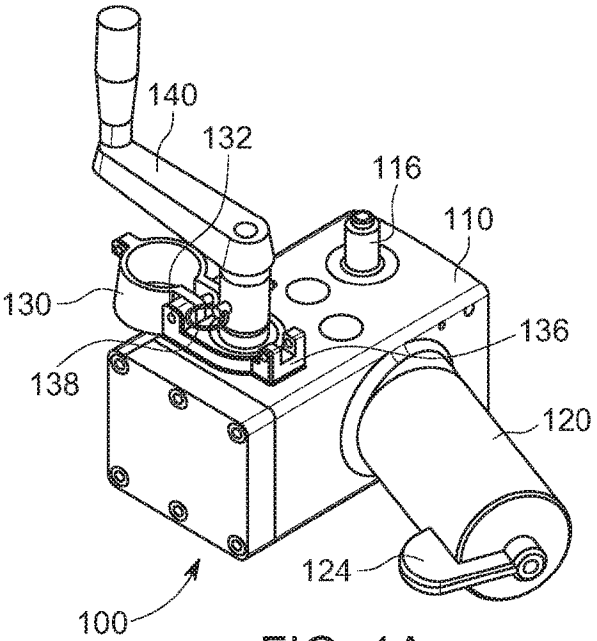

FIGS. 1A, 1B, and 1C depict perspective, side, and top views, respectively of an exemplary motor-less cartridge ring gear engagement module (CRGEM) for actuating rotation of a turret, the CRGEM including an exemplary crank having a crank shaft oriented in a vertical direction. The motor-less CRGEM 100 (which may be the same motor-less CRGEM 125 shown in FIG. 1) has a gear box 110 having a gear system that is further detailed in FIG. 2. The gear box 110 houses gears that transfer rotation from the hand crank to a drive gear 117 (shown in FIGS. 3A and 3C), which drives rotation of a vehicle turret (not shown). The motor-less CRGEM 100 is configured to be in mechanical communication with, and cause rotation of, the turret. The gear box 110 is coupled to the turret and has a drive gear 117 fixed to a drive shaft 116 that may be in direct engagement with corresponding teeth on a ring gear on a vehicle body.

Figure 2:
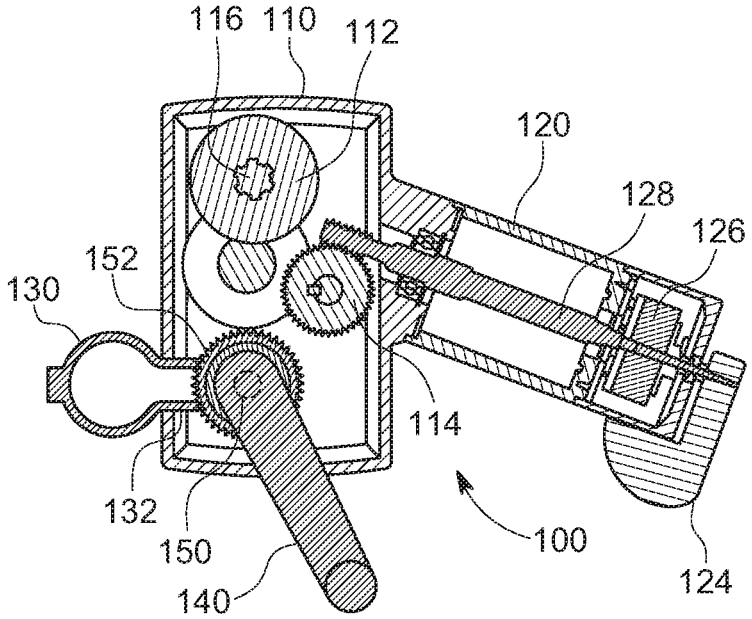
FIG. 2 depicts a cross-sectional top view of an exemplary motor-less CRGEM for actuating rotation of a turret, the CRGEM including an exemplary crank having a crank shaft oriented in a vertical direction.
Figure 3A:
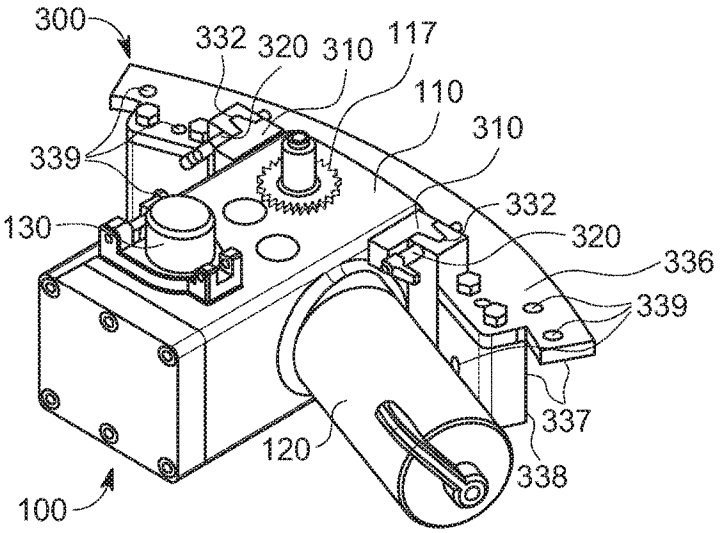
FIGS. 3A, 3B, 3C, and 3D depict perspective, side, top, and bottom views, respectively, of an exemplary motor-less CRGEM mounted on an exemplary cartridge mounting assembly (CMA).
Figure 3B:
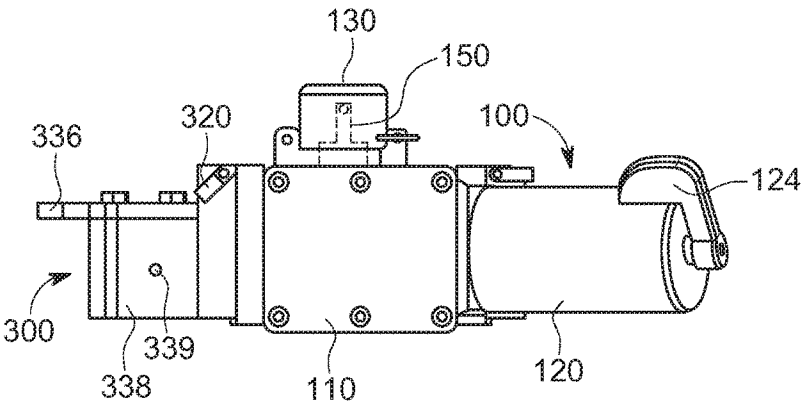
Figure 3C:
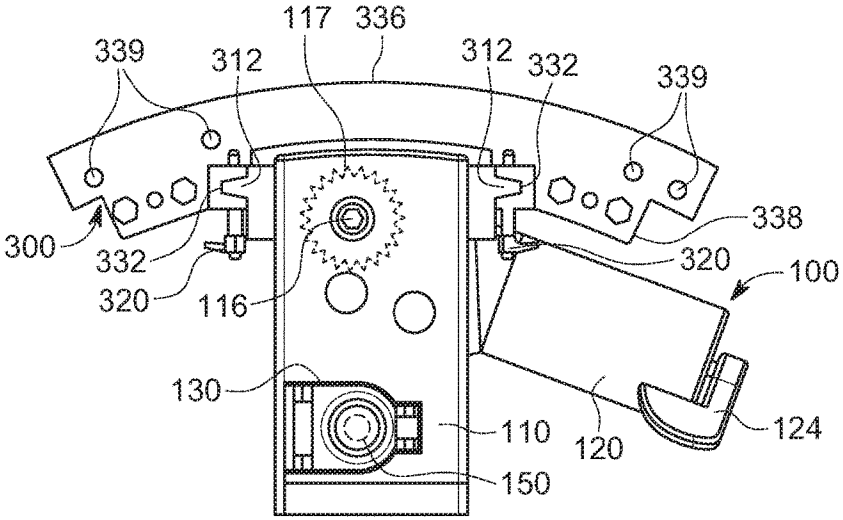
Figure 3D:
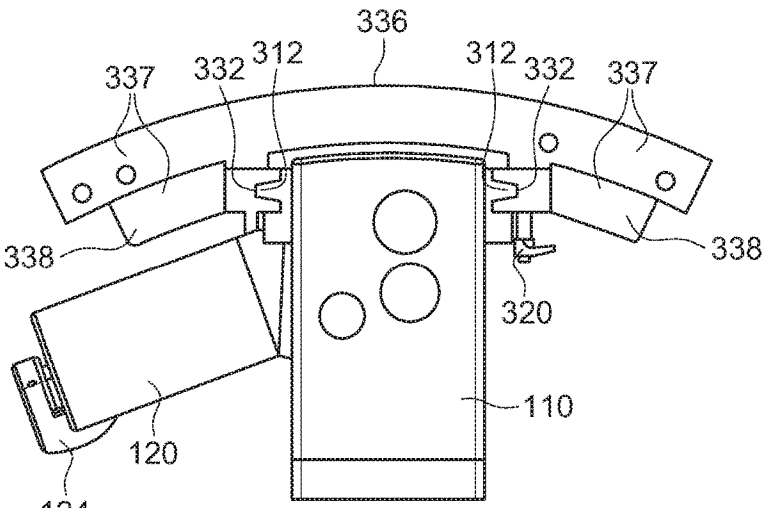

FIG. 2 depicts a cross-sectional top view of an exemplary motor-less CRGEM for actuating rotation of a turret, the CRGEM including an exemplary crank having a crank shaft oriented in a vertical direction. The cross-sectional view of a motor-less CRGEM 100 shown in FIG. 2 provides a view of the mechanical communication chain between the manual input shaft 150 and gears in the gear box 110. The gear box 110 has a first gear 112 that is in mechanical communication with a drive shaft 116 that drives rotation of the turret (not shown). The manual drive gear 152 (which is mechanically coupled to the manual input shaft 150) rotates and is in mechanical communication with the drive shaft 116 and is configured to cause rotation of the drive shaft 116. In the embodiment depicted, a brake shaft 128 is mechanically coupled to a second gear 114, which is in further mechanical communication with the first gear 112. Those skilled in the art will appreciate that gears within the gear housing can have a variety of configurations to transfer rotation from the manual input shaft 150 to the drive shaft 116.

A brake lever 124 is in communication with a brake 126 that is in further communication with the brake shaft 128. The brake 126 is generally configured to prevent rotation of the drive shaft 116. When the brake lever 124 is in an "engaged" position, the brake 126 is engaged to prevent rotation of the brake shaft 128. In at least one embodiment the brake 126 is a spring-loaded clutch plate. The brake 126 can also be mechanically disengaged in a variety of embodiments.

The manual input shaft 150 is incorporated in the gearbox 110. The manual input shaft 150 is in mechanical communication with the drive shaft 116 and the drive shaft 116 is fixed to the direct drive gear 117. A drive cap 130 is pivotably coupled to the gear box 110 with a hinge connection 132 such that the drive cap 130 is pivotably disposed over the manual input shaft 150. The side of the drive cap 130 opposite the hinge connection 132 defines a pin opening that substantially aligns with at least one other pin opening defined by the gearbox 110. A cap pin (not shown) may pass through the substantially aligned pin openings of the drive cap and the gear box. When the manual input shaft 150 needs to be accessed by a user, the pin is removed and the drive cap 130 is pivoted open about the hinge connection 132.

FIGS. 1A-1C and 2 depict the motor-less CRGEM 100 with the drive cap 130 in an open position to access the manual input shaft 150. When the drive cap 130 is open the manual input shaft 150 is revealed. The manual input shaft 150 transfers rotational energy to a gear system that is coupled to the drive gear 117. The motor-less CRGEM 100 may include a handle 140 coupled to the manual input shaft 150 for manual operation. The handle 140 has a coupling end that is configured to removably attach to the manual input shaft 150. Both the coupling end of the handle 140 and the manual input shaft 150 mutually define a pin passage that receives a handle pin 138. Such a configuration allows rotation of the handle 140 to be transferred to the manual input shaft 150 and eventually to the drive gear 117, thus rotating the turret.

In order to allow the manual input shaft to operate the system, a brake lever 124, which is in operative communication with the system 100, is pivotably disposed on the brake housing 120 to disengage and engage the brake 126. In some embodiments, the brake lever 124 can be configured to engage and disengage a manual input shaft to be in operative communication with the drive shaft 116.

The handle 140 can be connected by coupling the handle 140 to the manual input shaft 150. In at least one embodiment the handle 140 defines an opening that is configured to receive a portion of the manual input shaft 150. In such an embodiment a handle pin 138 is mutually received by an opening cumulatively defined by the manual input shaft 150 and the handle 140. In one embodiment the handle pin 138 is a spring pin.

Before operating the handle 140, the brake lever 124 may be pivoted to a "disengaged" position, to disengage the brake from the system. The brake 126 may disengage from the brake shaft 128, which allows rotation of all the gears in the system including the manual gear 152. The handle 140 mechanically couples to the manual input shaft 150 with a handle pin 138, such that manual rotation from the handle 140 is transmitted to the manual input shaft 150. Such rotation is transferred from the manual input shaft 150 to a manual drive gear 152 coupled thereto, which eventually transmits rotation to a first gear 112 in mechanical communication with the drive shaft 116. When the turret has been manually rotated to a desired position, the brake lever 124 can be pivoted to its "engaged" position, to engage the brake 126 in the system such that further rotation is prevented. It will be appreciated by those skilled in the art that alternate configurations for the braking system are within the scope of the technology disclosed herein. Further, it will be appreciated by those skilled in the art that gear couplings within the gear box 110 can have a variety of configurations to transmit the manual rotation of the handle 140 to rotation of the drive gear 117.

FIGS. 3A, 3B, 3C, and 3D depict perspective, side, top, and bottom views, respectively, of an exemplary motor-less CRGEM mounted on an exemplary cartridge mounting assembly (CMA). As detailed in FIGS. 3A-3D a mounting bracket provides a means of attaching a motorized system to a turret. The mounting bracket can be configured for ease in attaching the system to a turret. The mounting bracket can also be configured for ease in replacing a first motor-less (or motorized) system with a second motor-less (or motorized) system, should that become necessary or desired. In the embodiment shown in the figures, no tools are required to replace a first system having the slide flanges with a second system having the slide flanges.

A motor-less CRGEM 100 is shown as being mounted on the mounting bracket 300. At least some of the features, functions, and components of the mounting bracket 300 may be the same as, or similar to, the features, functions, and components of the mounting bracket disclosed in U.S. patent application Ser. No. 13/895,787, now issued as U.S. Pat. No. 9,759,506, entitled "Battery-Powered Motor Unit," filed May 16, 2013 by Domholt, et al., the entire contents of which are incorporated herein by reference. The mounting bracket is generally configured to couple to, and therefore mount a motor-less CRGEM system to, a structure. In a variety of embodiments, the structure can be a turret. In other embodiments the structure could be a vehicle. Those skilled in the art will appreciate that the motor-less CRGEM 100 can be coupled to a variety of locations and still remain within the scope of the current technology. In multiple implementations the motor-less CRGEM system only need be mounted to a location that allows mechanical communication between the motorized system and the turret such that mechanical movement of the motorized system is transferred to the turret. Examples of such mounting locations include the turret, a turret bearing, and the vehicle frame proximate to the turret.

FIGS. 4A, 4B, 4C, and 4D depict perspective, side, top, and bottom views, respectively, of an exemplary motor-less CRGEM mounted on an exemplary cartridge mounting assembly (CMA), the CRGEM including upper and lower crank handles. A motor-less CRGEM includes a top crank handle 400A and a bottom crank handle 400B. In some examples, only one of the top or bottom crank handles 400A, 400B may be employed at a single time (e.g., one of the handles 400A, 400B may be optional or not required). A bottom crank handle may be more convenient for a user to operate, since as shown in FIG. 1, the user may be sitting within a turret and so may be able to crank the CRGEM more easily sitting under the turret. In contrast with FIGS. 3A-3D, the CRGEM shown in FIGS. 4A-4D does not include a protective cap (e.g., the protective cap 130 may be an optional feature, at least in some embodiments).

Figure 4B:
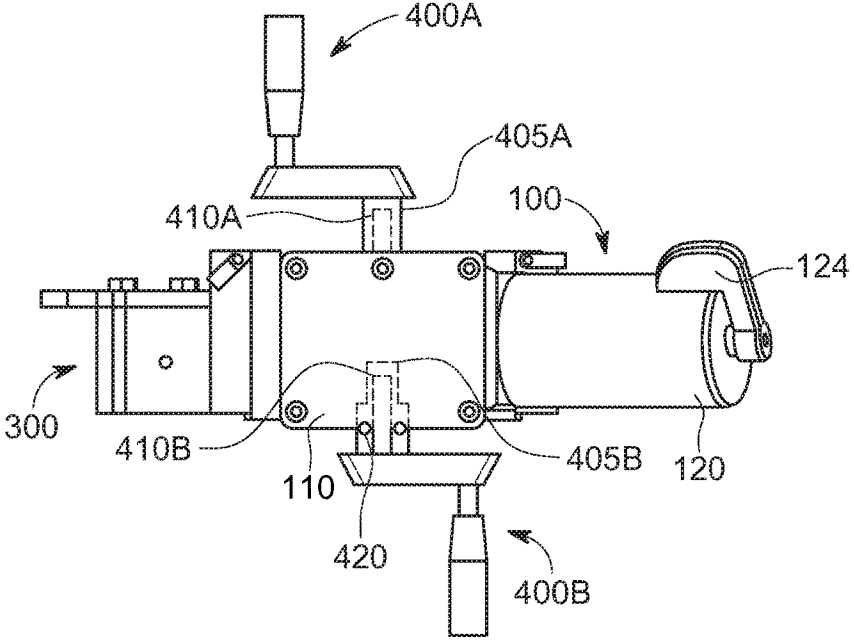
FIGS. 4A, 4B, 4C, and 4D depict perspective, side, top, and bottom views, respectively, of an exemplary motor-less CRGEM mounted on an exemplary cartridge mounting assembly (CMA), the CRGEM including upper and lower crank handles.
Figure 4A:
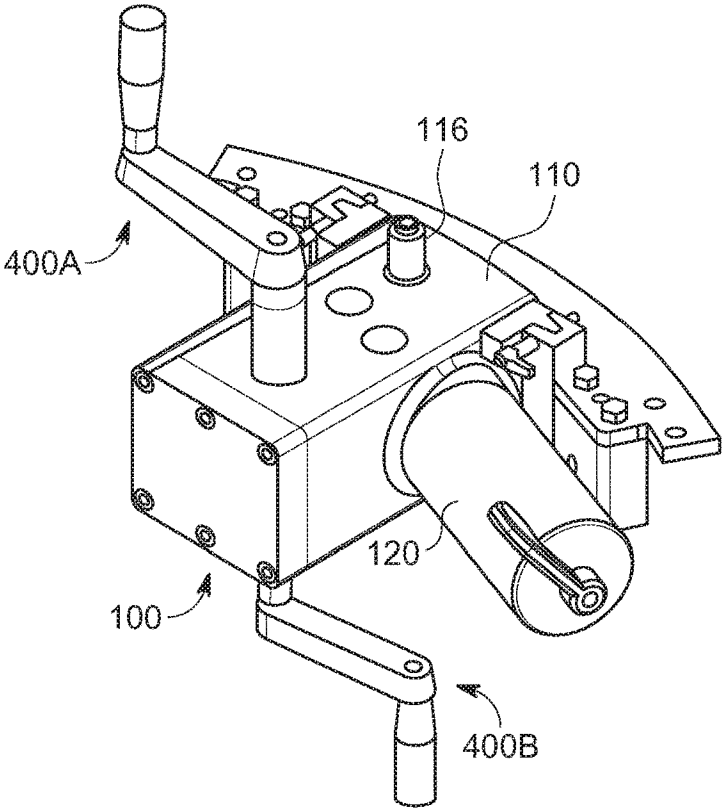
Figure 4D:
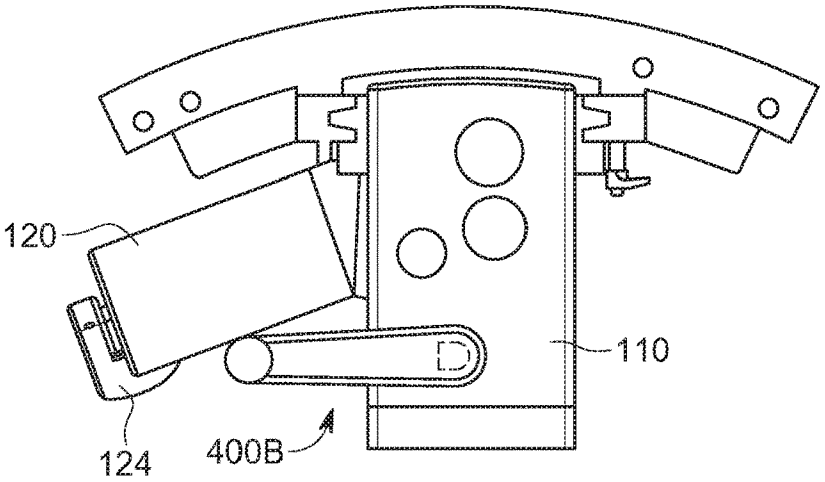
Figure 4C:
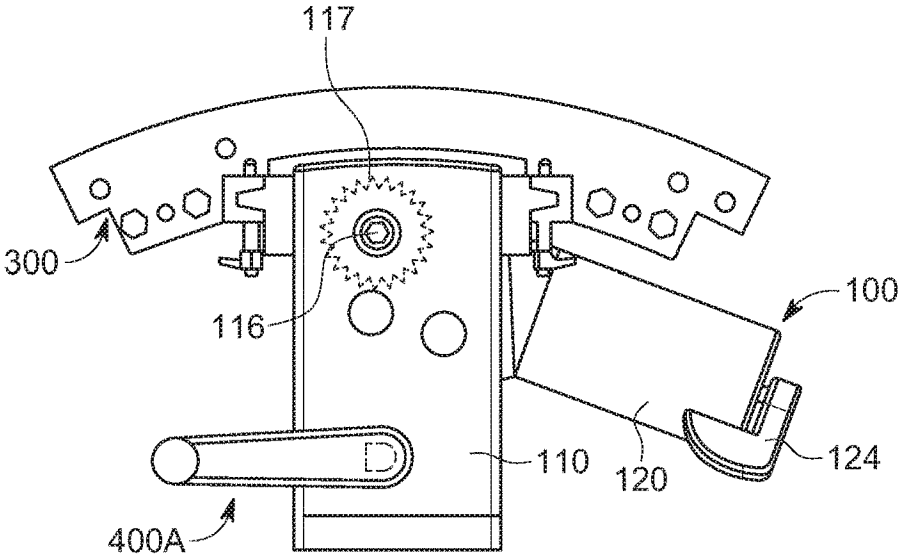

As depicted in FIG. 4B, a crank of the CRGEM may have one of a variety of types of connection structures. For example, the top crank 400A is shown as having a (recessed) female type connection 405A which mates with a (protruding) male type connection 410A of the CRGEM. In contrast, the bottom crank 400B includes a (protruding) male type connection 410B which mates with a (recessed) female type connection 405B of the CRGEM. In various embodiments, the male/female connections may be the different than the exact structures shown in FIG. 4B (e.g., the top crank 400A may include a male connection, while the bottom crank 400B may include a female connection). The bottom crank 400B includes a ball bearing 420, which may include an outer race and an inner race. The ball bearing 420 may advantageously enable smooth operation of the crank 400B by reducing rotational friction and supporting the cranking force applied by a user rotating the crank 400B. As shown in FIGS. 4C and 4D, the (protruding) male type connection features are shown as having a D-shaped cross-section, which may engage with a (recessed) female type connection that also has a D-shaped cross-section.

As used herein, the phrase "mechanical communication" is used to describe the configuration of at least two components where at least one component is configured to transmit kinetic energy to at least one other component. Generally, such components can be directly attached, indirectly attached, directly interfacing with, and/or indirectly interfacing with. The term "direct engagement" is used to describe the configuration of two or more components that are in physical contact. The term "substantially orthogonal" means two lines/axes/vectors (or two normal vectors of two planes) having an angle of about 75°, 80°, 85°, 90°, 95°, 100°, or about 105° between them, or a line/axis/vector and a normal vector of a plane having an angle of about −15°, −10°, −5°, 0°, 5°, 10°, or about 15° between them. The term "substantially parallel" means two lines/axes/vectors (or two planes with normal vectors) having an angle of about −15°, −10°, −5°, 0°, 5°, 10°, or about 15° between them.

In various embodiments, a turret-rotating system may include a main drive gear 117 configured to engage a geared perimeter of a circular ring gear 115, where the main drive gear and the circular ring gear may move relative to one another in response to rotation of the main drive gear. The main drive gear may, for example, be configured to rotate in a rotation plane that is a horizontal plane. A turret-rotating system may include, in some embodiments, a manual input shaft 150 operable to rotate in response to a manual user input to rotate a handle 140 while the handle is releasably coupled to the manual input shaft. In various implementations, rotation of any one of the manual input shaft and the main drive gear may impart rotation upon the other, such that rotation of the handle while coupled to the manual input shaft may impart rotation upon the manual input shaft and the main drive gear. In at least some embodiments, the manual input shaft and the main drive gear may be in continuous mechanical communication in all operating modes. Some examples of the turret-rotating system may be a motor-less turret-rotating system.

In various examples, the manual input shaft may extend from a gearbox 110 of the turret rotating system, and the manual input shaft extend substantially orthogonal relative to the rotation plane of the main drive gear. A turret-rotating system may include a drive shaft 116 fixedly coupled to the main drive gear and in mechanical communication with the manual input shaft such that rotation of the manual input shaft imparts rotation to both the drive shaft and the main drive gear. In some implementations, the manual input shaft extends from the gearbox of the turret rotating system. In some implementations, the drive shaft extends substantially orthogonal relative to the rotation plane of the main drive gear. In some implementations, the drive shaft 116 and the manual input shaft 150 extend substantially parallel to one another.

A turret-rotating system may include the handle 140 that is releasably coupled to the manual input shaft, such that when a user rotates the handle to impart rotation to the main drive gear, the handle rotates in a first plane that is substantially parallel to the rotation plane of the main drive gear. A turret-rotating system may include a manual drive cap 130 hingedly coupled to the gearbox and configured to rotate in a vertical plane that is substantially orthogonal to the rotation plane of the main drive gear. In a closed state (shown in FIGS. 3A-3C), the manual drive cap may cover a distal end of the manual input shaft, and in an opened state (shown in FIGS. 1A-1C), the manual drive cap may leave the distal end of the manual input shaft exposed.

A turret-rotating system may include a brake 126 mechanically coupled to a brake shaft 128, where the brake shaft may be mechanically coupled to the main drive gear, such that the brake may be configured to prevent rotation of the brake shaft to prevent rotation of the main drive gear. A turret rotating system may include a brake housing 120 that houses the brake and/or the brake shaft, wherein the brake housing may extend externally from the gearbox. In at least some implementations, rotation of any one of the brake shaft, the manual input shaft, and the main drive gear may impart rotation upon the other two, such that rotation of the handle while coupled to the manual input shaft imparts rotation upon the brake shaft, the manual input shaft, and the main drive gear. In some examples, the brake shaft, the manual input shaft, and the main drive gear are in continuous mechanical communication in all operating modes.

In various implementations, a turret-rotating system may include: a main drive gear configured to: (1) engage a geared perimeter of a circular ring gear that defines a first plane, (2) rotate in a second plane that is substantially parallel to the first plane, and (3) move relative to the circular ring gear in response to rotation of the main drive gear; a main drive shaft that: (1) is configured to fixedly couple to the main drive gear, (2) is configured to drive rotation of the main drive gear; and, a manual input shaft that: (1) is configured to rotate in response to a manual user input, (2) is in mechanical communication with the main drive shaft such that rotation of any one of the manual input shaft and the main drive shaft imparts rotation upon the other, and (3) extends along an axis that is substantially orthogonal to the first plane.

The turret-rotating system may further include a handle configured to mechanically couple to the manual input shaft, such that when a user rotates the handle while the handle is mechanically coupled to the manual input shaft: (1) the handle imparts rotation to the manual input shaft, and (2) the handle rotates in a third plane that is substantially parallel to the first plane. Some examples may include a gearbox, where the manual input shaft and the main drive shaft extend from the gearbox, and the gearbox houses at least one gear configured to facilitate the mechanical communication between the manual input shaft and both the main drive shaft and the main drive gear. The manual input shaft and the main drive shaft may be located at the same side of the gearbox, for example.

Some embodiments may include a manual drive cap hingedly coupled to the gearbox and configured to rotate in a fourth plane that is substantially orthogonal to the first plane, such that in a closed state, the manual drive cap covers a distal end of the manual input shaft, and in an opened state, the manual drive cap leaves the distal end of the manual input shaft exposed. Some examples may include a brake mechanically coupled to a brake shaft, where the brake shaft is in mechanical communication with the main drive shaft, such that the brake is configured to prevent rotation of the brake shaft that in turn prevents rotation of the main drive shaft. Some examples may include a brake housing that houses the brake, where the brake housing extends externally from the gearbox. In some embodiments, rotation of any one of the brake shaft, the manual input shaft, and the main drive shaft may impart rotation upon the other two. In various examples, the brake shaft, the manual input shaft, and the main drive shaft may in continuous mechanical communication in all operating modes.

The turret-rotating system may include a manual drive gear fixedly coupled to the manual input shaft configured to facilitate the mechanical communication between the manual input shaft and both the main drive shaft and the main drive gear. In some examples, the manual drive gear may be configured to rotate in a fifth plane that is substantially parallel to the first plane. The main drive gear may be configured to directly engage the geared perimeter of the circular ring gear. The main drive gear may be configured to indirectly engage the geared perimeter of the circular ring gear. For example, there may be intermediate gear or other mechanical component(s) that is mechanically coupled between the main drive gear and the circular ring gear. In some examples, the turret-rotating system may be a motor-less turret rotating system.

Although various embodiments have been described with reference to the Figures, other embodiments are possible. A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated.

What is claimed is:

1. A motor-less turret-rotating system comprising:

a main drive gear configured to: (1) engage a geared perimeter of a circular ring gear that defines a first plane, (2) rotate in a second plane that is substantially parallel to the first plane, and (3) move relative to the circular ring gear in response to rotation of the main drive gear;

a main drive shaft that: (1) is configured to fixedly couple to the main drive gear, and (2) is configured to drive rotation of the main drive gear;

a manual input shaft that: (1) is configured to rotate in response to a manual user input, (2) is in mechanical communication with the main drive shaft such that rotation of any one of the manual input shaft and the main drive shaft imparts rotation upon the other, and (3) extends along an axis that is substantially orthogonal to the first plane; and, a gearbox, wherein the manual input shaft and the main drive shaft extend externally from the gearbox, and the gearbox houses at least one gear configured to facilitate the mechanical communication between the manual input shaft and both the main drive shaft and the main drive gear, and wherein the main drive gear is fixedly coupled to the main drive shaft external to the gearbox.

2. The turret-rotating system of claim 1, further comprising a handle configured to mechanically couple to the manual input shaft, such that when a user rotates the handle while the handle is mechanically coupled to the manual input shaft: (1) the handle imparts rotation to the manual input shaft, and (2) the handle rotates in a third plane that is substantially parallel to the first plane.

3. The turret-rotating system of claim 1, wherein the manual input shaft and the main drive shaft are disposed at the same side of the gearbox.

4. The turret-rotating system of claim 1, further comprising a manual drive cap hingedly coupled to the gearbox and configured to rotate in a fourth plane that is substantially orthogonal to the first plane, such that in a closed state, the manual drive cap covers a distal end of the manual input shaft, and in an opened state, the manual drive cap leaves the distal end of the manual input shaft exposed.

5. The turret-rotating system of claim 1, further comprising a brake mechanically coupled to a brake shaft, wherein the brake shaft is in mechanical communication with the main drive shaft, such that the brake is configured to prevent rotation of the brake shaft that in turn prevents rotation of the main drive shaft.

6. The turret-rotating system of claim 5, further comprising a brake housing that houses the brake, wherein the brake housing extends externally from the gearbox.

7. The turret-rotating system of claim 5, wherein:

rotation of any one of the brake shaft, the manual input shaft, and the main drive shaft imparts rotation upon the other two, and, the brake shaft, the manual input shaft, and the main drive shaft are in continuous mechanical communication in all operating modes.

8. The turret-rotating system of claim 1, further comprising a manual drive gear fixedly coupled to the manual input shaft configured to facilitate the mechanical communication between the manual input shaft and both the main drive shaft and the main drive gear, wherein the manual drive gear is configured to rotate in a fifth plane that is substantially parallel to the first plane.

9. The turret-rotating system of claim 1, wherein the main drive gear is further configured to directly engage the geared perimeter of the circular ring gear.

10. A motor-less turret-rotating system comprising:

a main drive gear configured to: (1) engage a geared perimeter of a circular ring gear that defines a first plane, (2) rotate in a second plane that is substantially parallel to the first plane, and (3) move relative to the circular ring gear in response to rotation of the main drive gear;

a main drive shaft that: (1) is configured to fixedly couple to the main drive gear, and (2) is configured to drive rotation of the main drive gear;

a manual input shaft that: (1) is configured to rotate in response to a manual user input, (2) is in mechanical communication with the main drive shaft such that rotation of any one of the manual input shaft and the main drive shaft imparts rotation upon the other, and (3) extends along an axis that is substantially orthogonal to the first plane; and, a gearbox, wherein the manual input shaft and the main drive shaft extend externally from a same side of the gearbox, and wherein the main drive gear is fixedly coupled to the main drive shaft external to the gearbox.

11. The turret-rotating system of claim 10, further comprising a handle configured to mechanically couple to the manual input shaft, such that when a user rotates the handle while the handle is mechanically coupled to the manual input shaft: (1) the handle imparts rotation to the manual input shaft, and (2) the handle rotates in a third plane that is substantially parallel to the first plane.

12. The turret-rotating system of claim 10, further comprising a manual drive cap hingedly coupled to the gearbox and configured to rotate in a fourth plane that is substantially orthogonal to the first plane, such that in a closed state, the manual drive cap covers a distal end of the manual input shaft, and in an opened state, the manual drive cap leaves the distal end of the manual input shaft exposed.

13. The turret-rotating system of claim 10, further comprising a brake mechanically coupled to a brake shaft, wherein the brake shaft is in mechanical communication with the main drive shaft, such that the brake is configured to prevent rotation of the brake shaft that in turn prevents rotation of the main drive shaft.

14. The turret-rotating system of claim 13, wherein:

rotation of any one of the brake shaft, the manual input shaft, and the main drive shaft imparts rotation upon the other two, and, the brake shaft, the manual input shaft, and the main drive shaft are in continuous mechanical communication in all operating modes.

15. A motor-less turret-rotating system comprising:

a main drive gear configured to: (1) engage a geared perimeter of a circular ring gear that defines a first plane, (2) rotate in a second plane that is substantially parallel to the first plane, and (3) move relative to the circular ring gear in response to rotation of the main drive gear;

a main drive shaft that: (1) is configured to fixedly couple to the main drive gear, and (2) is configured to drive rotation of the main drive gear;

a manual input shaft that: (1) is configured to rotate in response to a manual user input, (2) is in mechanical communication with the main drive shaft such that rotation of any one of the manual input shaft and the main drive shaft imparts rotation upon the other, and (3) extends along an axis that is substantially orthogonal to the first plane;

a handle configured to mechanically couple to the manual input shaft, such that when a user rotates the handle while the handle is mechanically coupled to the manual input shaft: (1) the handle imparts rotation to the manual input shaft, and (2) the handle rotates in a third plane that is substantially parallel to the first plane; and, a gearbox, wherein the manual input shaft and the main drive shaft extend externally from the gearbox, and the gearbox houses at least one gear configured to facilitate the mechanical communication between the manual input shaft and both the main drive shaft and the main drive gear, and wherein the main drive gear is fixedly coupled to the main drive shaft external to the gearbox.

16. The turret-rotating system of claim 15, further comprising a brake mechanically coupled to a brake shaft, wherein the brake shaft is in mechanical communication with the main drive shaft, such that the brake is configured to prevent rotation of the brake shaft that in turn prevents rotation of the main drive shaft.

17. The turret-rotating system of claim 16, wherein:

rotation of any one of the brake shaft, the manual input shaft, and the main drive shaft imparts rotation upon the other two, and, the brake shaft, the manual input shaft, and the main drive shaft are in continuous mechanical communication in all operating modes.

18. The turret-rotating system of claim 17, further comprising a manual drive cap hingedly coupled to the gearbox and configured to rotate in a fourth plane that is substantially orthogonal to the first plane, such that in a closed state, the manual drive cap covers a distal end of the manual input shaft, and in an opened state, the manual drive cap leaves the distal end of the manual input shaft exposed.

* * * * *